US005659841A

United States Patent [19]

Umeda et al.

[11] Patent Number: 5,659,841

[45] Date of Patent: Aug. 19, 1997

[54] ELECTROSTATIC RECORDING CONTROL METHOD AND ELECTROSTATIC RECORDING APPARATUS

[75] Inventors: Takao Umeda; Hiroyuki Mabuchi; Masayasu Anzai; Shinji Asai; Kozi Kato; Yoshihiro Gunji, all of Ibaraki, Japan

[73] Assignee: Hitachi Koki Co., Ltd., Tokyo, Japan

[21] Appl. No.: 580,354

[22] Filed: Dec. 28, 1995

[30] Foreign Application Priority Data

Feb. 13, 1995 [JP] Japan ..... 7-024214

[51] Int. Cl.[6] ..... G03G 15/06

[52] U.S. Cl. ..... 399/55; 399/53

[58] Field of Search ..... 355/203, 208, 355/245, 246, 326 R, 327, 328; 399/9, 24, 26, 50, 51, 53, 54, 55, 56, 159, 222, 223

[56] References Cited

U.S. PATENT DOCUMENTS

| | | | |
|---|---|---|---|
| 4,078,929 | 3/1978 | Gundiach | 96/1.2 |
| 5,119,131 | 6/1992 | Paolini et al. | 355/208 |
| 5,138,380 | 8/1992 | Umeda et al. | 355/208 |
| 5,157,441 | 10/1992 | Scheuer et al. | 355/208 |
| 5,196,886 | 3/1993 | Nakane et al. | 355/246 |
| 5,208,632 | 5/1993 | Hurwitch et al. | 355/208 |
| 5,208,636 | 5/1993 | Rees et al. . | |
| 5,227,270 | 7/1993 | Scheuer et al. | 355/328 X |
| 5,541,721 | 7/1996 | Scheuer et al. | 355/326 R |

FOREIGN PATENT DOCUMENTS 4408978 9/1994 Germany .

*Primary Examiner*—Sandra L. Brase

*Attorney, Agent, or Firm*—Sughrue, Mion, Zinn, Macpeak & Seas

[57] ABSTRACT

An electrostatic recording control method wherein there are provided a single surface potential sensor between a first and second developer units, a detector for detecting the characteristic of a factor influencing the dark attenuation characteristic of the sensitive body, comprising the steps of: irradiating the surface of a charged sensitive body with the test pattern having prescribed exposure energy by an exposure system to form a test electrostatic image on the photosensitive body; passing the test electrostatic latent image with the developing function of the first developer unit stopping to measure the surface potential of the test electrostatic latent image by the sensor; changing the control setting potential at a position where the sensor is set according to the output from the detector; comparing the potential measured by the passing step with the control setting potential changed by the changing step to control one of the voltage to be applied to the latent image forming charger and the exposure energy for forming the test pattern so that the measurement potential is a control setting potential; forming a test electrostatic latent image on the photosensitive body after the comparing step; applying a prescribed bias to the first developer unit to form the first toner image corresponding to the test electrostatic latent image; and measuring the surface potential of the first toner image to set the bias voltage of the second developer unit according to the value measured.

16 Claims, 11 Drawing Sheets

ELECTROSTATIC RECORDING CONTROL METHOD AND ELECTROSTATIC RECORDING APPARATUS

BACKGROUND OF THE INVENTION

1. Field of the Invention

The present invention relates to an electrostatic recording control method and apparatus for an electrophotographic printer or copier, and more particularly to an electrostatic recording control method and apparatus capable of making color printing by combination of normal development and reversal development such as a tri-level development system.

2. Description of the Related Art

There has been known a method of making two-color printing by one rotation of a photosensitive body in which normal development and reversal development are combined to form an electrostatic latent image on a photosensitive body and the electrostatic latent image thus formed is developed by two color developers charged with opposite polarities to form a two-color image. A "tri-level system" is well known in which a latent image with three potential levels on a photosensitive body is formed and the latent image thus formed is developed by two color developers charged with opposite polarities to form a two color image (see U.S. Pat. No. 4,078,929).

Now referring to FIGS. 17A and 17B, such a tri-level system will be explained. Irradiation of a photosensitive body with optical energy with three levels of 0, $L_W$ and $L_L$ provides latent image potentials of $V_{H1}$, $V_{W1}$ and $V_{L1}$ on the surface (FIG. 17A. In the plus-charging of the photosensitive body, an area having a latent image potential of $V_{H1}$ attracts minus toners, resulting in normal development, another area having a latent image potential of $V_{L1}$ attracts plus toners, resulting in reversal development and a still another area having an intermediate potential of $V_{W1}$ becomes a non-developed white area.

For the above reason, a development bias voltage $V_{B1}$ for the normal development area must be larger than $V_{W1}$ and smaller than $V_{H1}$ and a development bias voltage $V_{B2}$ must be smaller than $V_{W1}$ and larger than $V_{L1}$.

When the photosensitive body is used for a long time, as shown in FIG. 17B, the charging potential $V_H$ decreases whereas $V_W$ and $V_L$ produced by exposure to light increase. Since the increasing coefficient of $V_L$ is larger than that of $V_W$, after time $t_1$, $V_{B2}<V_L$ and after time $t_1$, $V_{B1}<V_W$. This makes it impossible to perform reversal development and subjects the white area which should not be developed to normal development. As a result, the image quality will be greatly deteriorated.

U.S. Pat. No. 5,208,632 describes in the prior art a method for correcting reading errors among plural surface potential sensors owing to impairing by charged particles such as toners.

In controlling the latent image potential of a photosensitive body, the measurement precision of a surface potential sensor is critical. If it is not assured, suitable control cannot be done. Generally, use of the surface potential sensor for a long time leads to invasion of toners or paper particles in the sensor, thus providing a measurement error or malfunction.

Further, where plural surface potential sensors, which provide different characteristic changes according to their different characteristics and locations, are used, the values measured by these plural potential cannot be accurately compared with one another, which will reduce reliability of control of latent image potential.

Since the surface potential sensor itself is expensive, the electrostatic recording apparatus is also expensive. The maintenance cost such as periodic calibration of the surface potential sensor cannot be neglected.

The main cause of malfunction of the surface potential sensor is invasion of toners or the like into a sensor probe as described above. In recent years, a negative-feedback type surface potential sensor has been used to correct the distance between an object to be measured and it. In this surface potential sensor, a voltage having the same polarity as the potential of the object to be measured is applied to the metallic box for a sensor probe. The applied voltage, which differs between an absolute display type and a relative display type, ranges from ten to thousand volts.

A digital-type electrostatic recording apparatus generally uses reversal development as a development manner. Therefore, where an OPC with minus charging is used, since the polarity of a toner is minus and that of the voltage applied to the box for a surface potential sensor is also minus, the toners and sensors repel each other so that the toners are hard to be applied to the sensor.

The color printing electrostatic recording apparatus on the basis of both normal development and reversal development uses two kinds of plus and minus toners. The plus toners are electrically attracted to the metallic box of the sensor and likely to be contaminated. The latent image potential in the photosensitive body cannot be suitably controlled, which will reduce the reliability of operation.

SUMMARY OF THE INVENTION

The present invention has been made to obviate the disadvantage of the prior art as described above, and an object of the present invention is to provide an electrostatic recording control method and electrostatic recording apparatus which can cope with secular deterioration of a photosensitive body and changes in environment such as temperature and humidity to provide unaltered stabilized image quality.

Another object of the present invention is to provide an electrostatic recording control apparatus which can effectively prevent reduction in precision of a surface potential sensor to realize color printing with high image quality.

In order to attain the above object, according to a first aspect of the invention, there is provided an electrostatic recording method in which with a charger for forming a latent image, an exposure means, a first developer unit loaded with a first-color developer and a second developer loaded with a second-color developer provided around a photosensitive body, an electrostatic latent image, which is formed on the photosensitive body by said charger and said exposure means, is successively developed by said first-color developer and said second-color developer charged with opposite polarities to form a two-color toner image.

The first aspect of the present invention is characterized in that there are provided a single surface potential sensor provided in the neighborhood of said photosensitive body and between said first developer unit and said second developer unit, and a characteristic changing detecting means such as a print-page-number counter, thermometer and hygrometer for detecting the characteristic of a factor influencing the dark decay characteristic of said photosensitive body; said electrostatic recording control method comprising the steps of:

irradiating the surface of a photosensitive body charged by said charger with the test pattern having prescribed exposure energy to it by said exposure means to form a test electrostatic image on said photosensitive body;

passing said test electrostatic latent image with the developing function of said first developer unit substantially stopping to measure the surface potential of the test electrostatic latent image by said surface potential sensor;

changing the control setting potential at a position where said surface potential sensor is set on the basis of the output from said characteristic change detecting means;

comparing the potential measured by said passing step with the control setting potential changed by said changing step to control either one of the voltage to be applied to said latent image forming charger and the exposure energy for forming said test pattern so that the measurement potential is a control setting potential;

forming a test electrostatic latent image on said photosensitive body after said comparing step;

applying a prescribed bias voltage to said first developer unit to form the first toner image corresponding said test electrostatic latent image; and measuring the surface potential of said first toner image to set the bias voltage of said second developer unit on the basis of the value thus measured.

In order to attain the above object, according to a second aspect of the present invention, there is provided an electrostatic recording method in which with a charger for forming a latent image, an exposure means, a first developer unit loaded with a first-color developer and a second developer unit loaded with a second-color developer provided around a photosensitive body, an electrostatic latent image, which is formed on the photosensitive body by said charger and said exposure means, is successively developed by said first-color developer and said second-color developer charged with opposite polarities to form a two-color toner image.

The second aspect of the invention is characterized in that said photosensitive body is a photosensitive drum on the outer periphery of which a moving photosensitive sheet is wound, and there are provided a voltage applying means for applying a voltage to a conductive cap seal covering an inlet/outlet for the photosensitive sheet of said drum and a single surface potential sensor provided in the neighborhood of said photosensitive body and between said first developer unit and said second developer unit, said electrostatic recording controlling method comprising:

applying a control setting potential to said cap seal by said voltage applying means when said cap seal is opposite to said surface potential sensor while said photosensitive drum rotates to measure and store the surface potential of said cap seal by said surface potential sensor;

irradiating the surface of a photosensitive body charged by said charger with the test pattern having prescribed exposure energy by said exposure means to form a test electrostatic image on said photosensitive body;

passing said test electrostatic latent image with the developing function of said first developer unit substantially stopping to measure the surface potential of the test electrostatic latent image by said surface potential sensor;

comparing the storage potential stored by said applying step with the measurement potential measured by said passing step to control one of the voltage to be applied to said latent image forming charger and the exposure energy for forming said test pattern so that the measurement potential is a storage potential;

forming a test electrostatic latent image on said photosensitive body after said comparing step again;

applying a prescribed bias voltage to said first developer unit to form the first toner image corresponding said test electrostatic latent image; and measuring the surface potential of said first toner image to set the bias voltage of said second developer unit on the basis of the value thus measured.

In order to attain the above object, according to a third aspect of the present invention, there is provided an electrostatic recording apparatus in which with a charger for forming a latent image, an exposure means, a first developer unit loaded with a first-color developer and a second developer unit loaded with a second-color developer provided around a photosensitive body, an electrostatic latent image, which is formed on the photosensitive body by said charger and said exposure means, is successively developed by said first-color developer and said second-color developer charged with opposite polarities to form a two-color toner image.

The third aspect of the present invention is characterized by comprising:

a single surface potential sensor provided in the neighborhood of said photosensitive body and between said first developer unit and said second developer unit;

a characteristic changing detecting means for detecting the characteristic of a factor influencing the dark decay characteristic of said photosensitive body;

a changing means for changing a control setting potential on the basis of the output from said characteristic change detecting means; and control means for measuring the surface potential of a non-image region formed on said photosensitive body by said surface potential sensor and controlling one of the voltage to be applied to said charger and exposure energy of said exposure means so that the measured potential is a control setting potential produced from said changing means.

In order to attain the above object, according to a fourth aspect of the invention, there is provided an electrostatic recording apparatus in which with a charger for forming a latent image, an exposure means, a first normal developer unit loaded with a first-color developer and a second reversal developer unit loaded with a second-color developer provided around a photosensitive body, an electrostatic latent image, which is formed on the photosensitive body by said charger and said exposure means, is successively developed by said first-color developer and said second-color developer charged with opposite polarities to form a two-color toner image.

The fourth aspect of the present invention is characterized in that a surface potential sensor is provided in the neighborhood of said photosensitive body and between said first developer unit and said second developer unit, and a shielding member to which a voltage with the same polarity as the toner of said first normal developer unit is applied is provided between said first normal developer unit and the surface potential sensor.

In order to attain the above object, according to a fifth aspect of the present invention, there is provided an electrostatic recording apparatus in which with a charger for forming a latent image, an exposure means, a first reversal developer unit loaded with a first-color developer and a second normal developer unit loaded with a second-color developer provided around a photosensitive body, an electrostatic latent image, which is formed on the photosensitive body by said charger and said exposure means, is successively developed by said first-color developer and said second-color developer charged with opposite polarities to form a two-color toner image.

The fifth aspect of the present invention is characterized in a surface potential sensor is provided in the neighborhood of said photosensitive body and between said first reversal developer unit and said second normal developer unit, and a shielding member to which a voltage with the same polarity as the toner of said second normal developer unit is applied is provided between said surface potential sensor and said second normal developer unit.

In order to attain the above object, according to a sixth aspect of the invention, there is provided an electrostatic recording method in which with a charger for forming a latent image, an exposure means, a first developer unit loaded with a first-color developer and a second developer unit loaded with a second-color developer provided around a photosensitive body, an electrostatic latent image, which is formed on the photosensitive body by said charger and said exposure means, is successively developed by said first-color developer and said second-color developer charged with opposite polarities to form a two-color toner image.

The sixth aspect of the present invention is characterized in that said photosensitive body is a photosensitive drum on the outer periphery of which a moving photosensitive sheet is wound, and there are provided a voltage applying means for applying a voltage to a conductive cap seal covering an inlet/outlet for the photosensitive sheet of said drum, and voltage application control means for controlling said voltage applying means so that the surface potential of said cap seal is reverse-biased for said first developer unit and said second developer unit when said cap seal faces said first and second developer units.

The above first and third aspects of the invention can provide unaltered stabilized image quality in accordance with time-varying deterioration of the photosensitive body and changes in environmental conditions such as temperature and humidity. Using a single surface potential sensor permits color printing based on combination of normal development and reversal development to be controlled.

The second aspect of the present invention is to provide unaltered stabilized image quality in accordance with the time-varying deterioration of the photosensitive body and changes in environmental conditions such as temperature and humidity even when the sensitivity of the surface potential sensor is reduced by any cause. Using a single surface potential sensor permits color printing based on combination of normal development and reversal development to be controlled.

The above fourth and fifth aspects of the invention can surely prevent reduction in precision of a surface potential sensor and invasion of toners into the probe of the surface potential sensor which leads to malfunction, and permits color printing based on combination of normal development and reversal development to be controlled.

The above sixth aspect of the invention can prevent attachment of toners when the cap seal passes the first developer unit and the second developer unit so that toner contamination in the apparatus can be surely prevented. The sixth aspect of the invention, therefore, permits color printing with high quality to be controlled, and wasteful consumption of toners to be canceled.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

Referring to drawings, an explanation will be given of concrete embodiments of the present invention.

Embodiment 1

Figure 1:
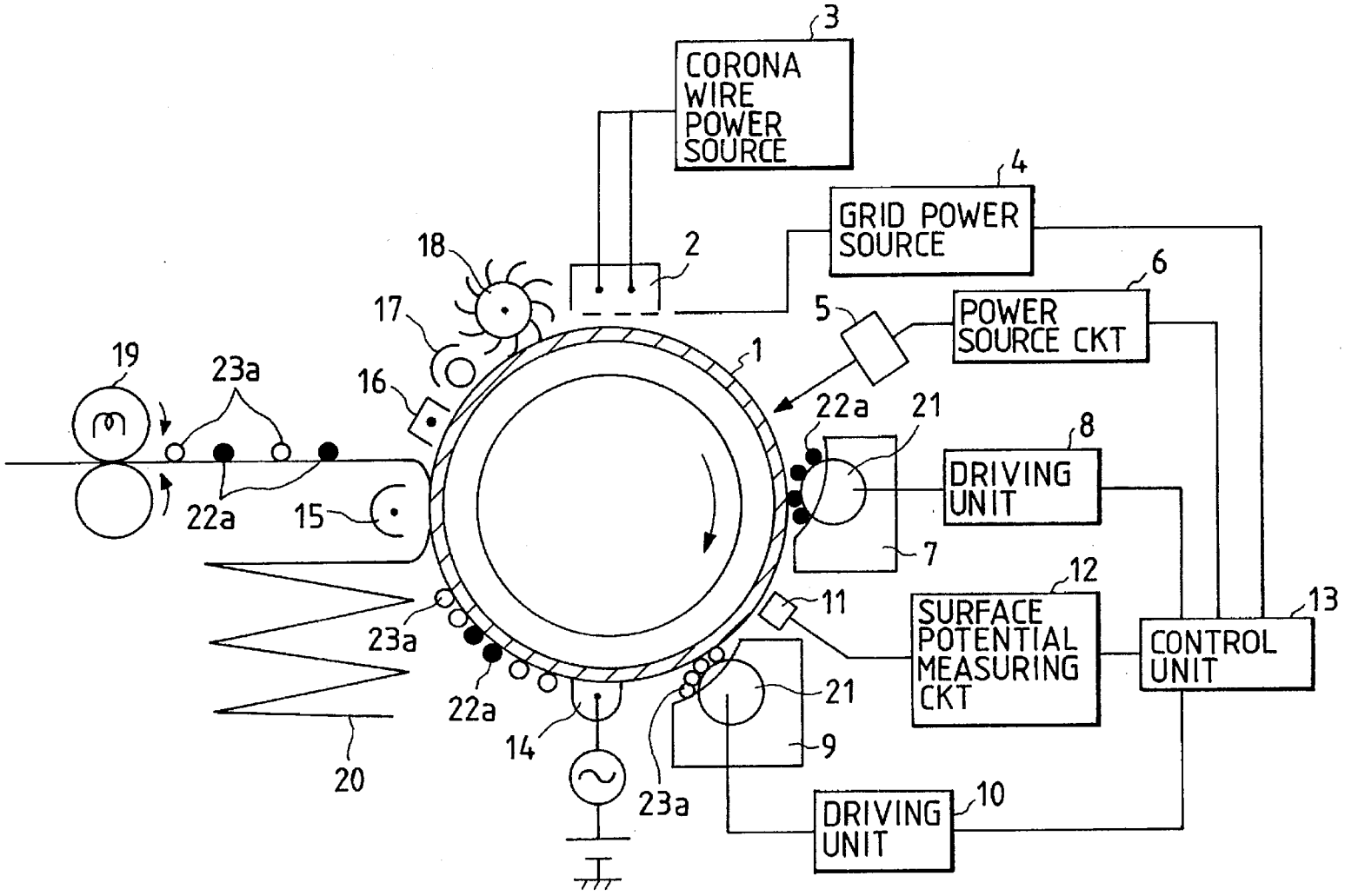
FIG. 1 is a schematic diagram of an arrangement around a drum of an electrostatic recording apparatus according to the first embodiment of the present invention.

FIG. 1 is a view illustrating a first embodiment which shows the structure of an electrostatic recording apparatus capable of implementing two-color printing by a single rotation.

A drum-shape photosensitive body 1 is uniformly charged by a scorotron charger 2. In FIG. 1, reference numeral 3 denotes a corona wire power source; 4 a grid power source; and 6 a power source circuit. The photosensitive body 1 is radiated with a laser optical system or an exposure system such as an LED to form an electrostatic latent image. The first color of the electrostatic latent image is developed by a first developer unit 7 and the second color thereof is developed by a second developer unit 9.

The charging polarities of the two kinds of toners are made the same by a pre-transfer charger 14. A two-color toner image (22*a*, 23*a*) on the photosensitive body 1 is transferred onto a sheet of paper (continuous or cut sheet of paper) by a transfer machine 15 and the two-color toner image (22*a*, 23*a*) is fixed on the sheet of paper 20 by a fixer 19. In FIG. 1, reference numeral 16 denotes an AC corotron for the photosensitive body; 17 eraser; and 18 cleaner.

A surface potential sensor 11 is placed between the first developer unit 7 and the second developer unit 9. A surface potential measuring circuit 12 is connected to the surface potential sensor 11. A control unit 13 connected to the sensor 11 serves to control a grid power source 4 of the charger 2, the power circuit 6 of the exposure system 5, the bias voltage of the first developer unit 7 or the second developer unit 9 or the magnetic pole position of a magnet roll. Driving units 8 and 10 serve to change the bias voltage of a developing roll and the magnetic pole position of the magnetic roll.

Figure 2:
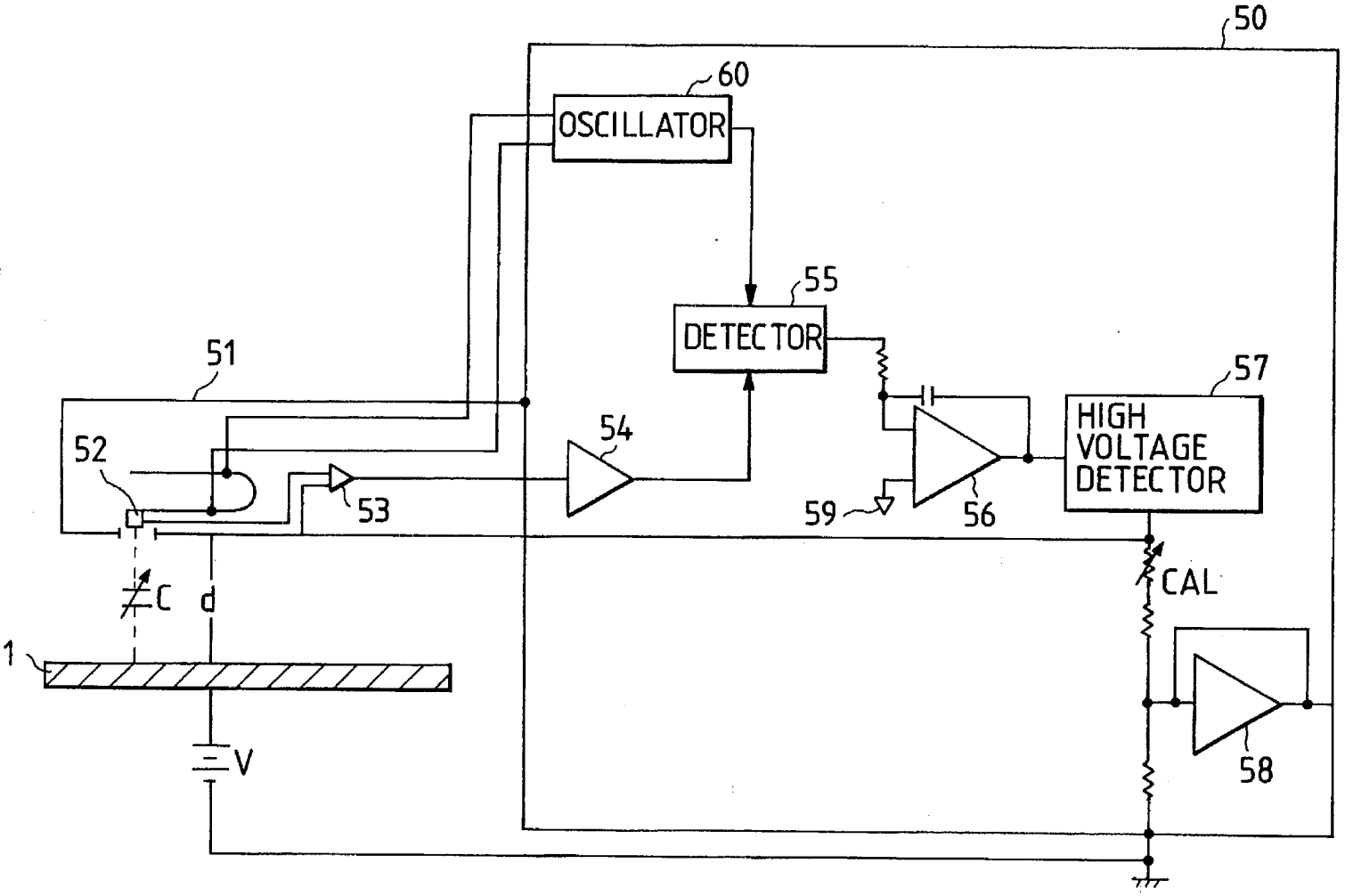
FIG. 2 is a schematic diagram of a surface potential sensor used in the electrostatic recording apparatus shown in FIG. 1.

The surface sensor 11 used in this embodiment may have the structure as shown in FIG. 2. FIG. 2 is a schematic view of the surface potential meter commercially available from Treck Co. Ltd in U.S.A. Such a vibrational capacity type surface potential meter mainly includes a body unit 50 and probe unit 51. The detecting inlet of the probe unit 51 has a diameter of 1–2 mm and a measurable spot diameter of 2–3 mm.

A sensor electrode 52 is arranged in the probe unit 51. When the sensor electrode 52 is caused to approach the surface of the photosensitive body 1, an electrostatic capacitance C is generated between the sensor electrode 52 and the photosensitive body 1. The electrostatic capacitance C is changed by a tuning fork (not shown) placed in the probe unit 51 so that an AC-modulated signal of the surface potential is induced. The AC signal is amplified by a pre-amplifier 53 in the probe unit 51 and an amplifier 54 in the body unit 50. The amplified signal is synchronously detected by a synchronous detector 55. An output from the detector 55 is sent to a high voltage generator 57 through an integrator 56 to generate a high potential. The high voltage is divided to provide an output with an output impedance lowered by an impedance matching circuit 58.

On the other hand, the high voltage produced from the high voltage generator 57 is also fed back to the probe unit 51 through a field loop 59. As a result, the potential of the metallic probe body is boosted to become equal to the photosensitive body 1, thus canceling the electrostatic capacitance C. In FIG. 2, reference numeral 60 denotes an oscillator for sampling.

Figure 3A:
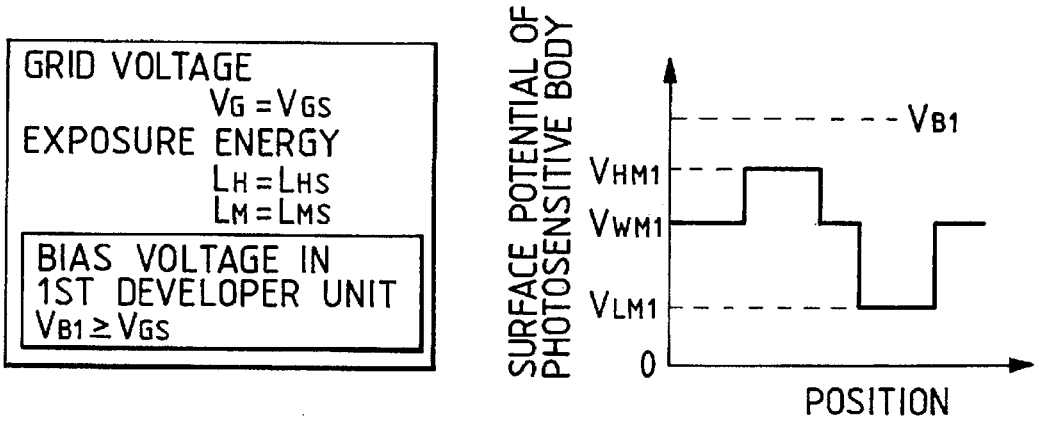
FIGS. 3A to 3C are graphs illustrating a control sequence of the electrostatic recording apparatus according to the first embodiment.
Figure 3B:
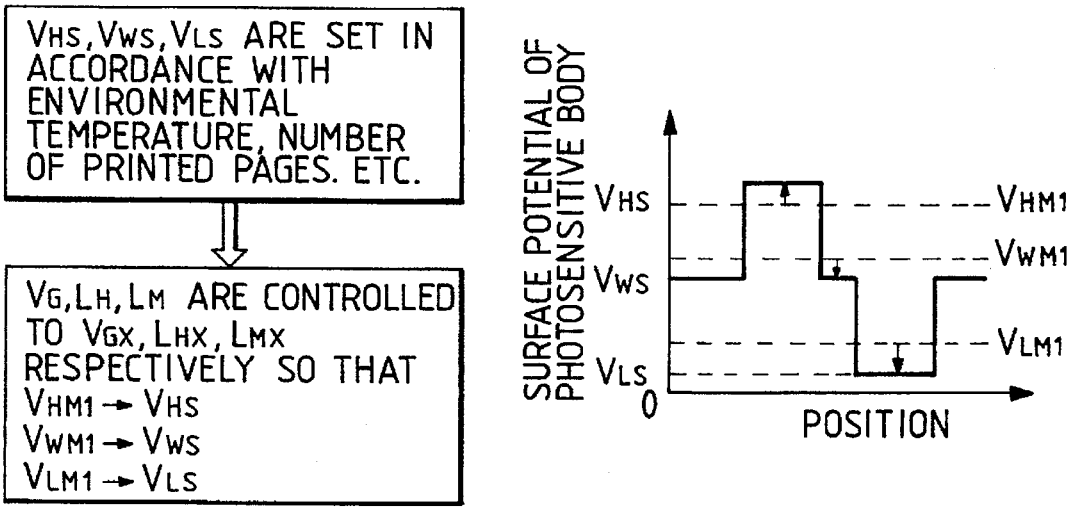
Figure 3C:
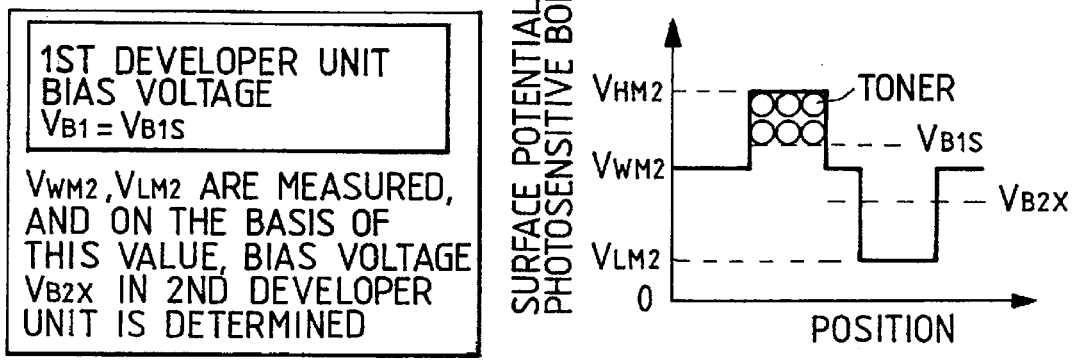

The control sequence of the electrostatic recording apparatus will be explained with reference to FIG. 3. It is now assumed that the first developer unit 7 makes normal development of color toners and the second developer unit 8 make reversal development of black toners.

Step (a): Measurement of an electrostatic latent image potential of a photosensitive body:

With the grid voltage $V_G$ of the grid power source 4 in the scorotron charger 2 set for standard $V_{GS}$ and with the exposure energies $L_M$ and $L_H$ in the exposure system 5 set for $L_{MS}$ and $L_{HS}$, respectively, the control unit 13 forms an electrostatic latent image pattern having three potential levels inclusive of a non-exposed portion on the photosensitive body 1 and sets the bias voltage $V_{B1}$ of the first developer unit 7 for a value larger than the grid setting voltage $V_{GS}$ ($V_{B1}>V_{GS}$).

Under such a condition, the surface potential sensor 11 downstream of the first developer unit 7 measures three potential levels ($V_{HM1}$, $V_{WM1}$, $V_{LM1}$) formed on the photosensitive body 1. During the two-color printing, $V_{WM1}$ represents the surface potential of the non-printed area (background), and $V_{HM1}$ and $V_{LM1}$ represent those of the printed area, respectively.

Figure 4:
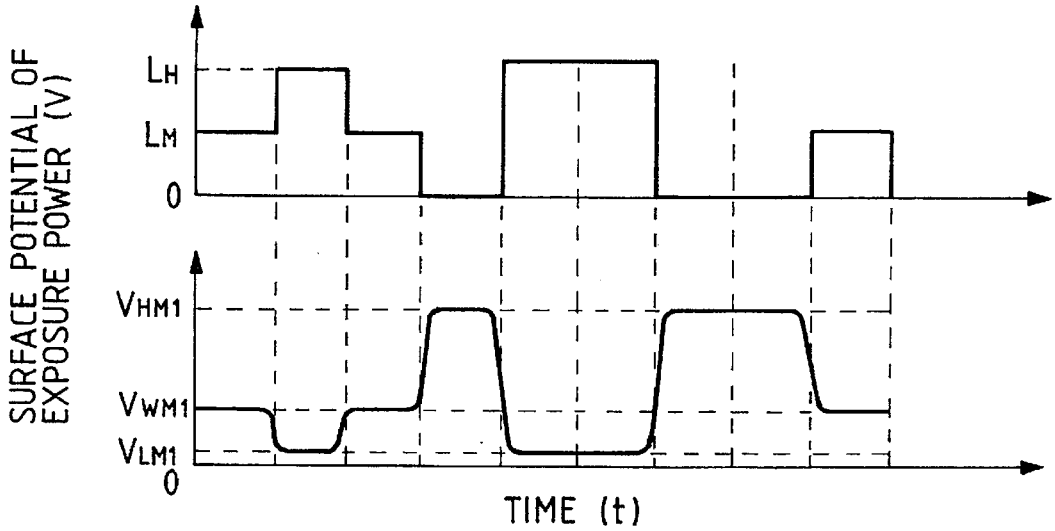
FIG. 4 is a graph illustrating a relation between the exposure power of a test pattern and the surface potential of the latent image pattern formed in the first embodiment.

FIG. 4 is a view showing an exposure pattern (upper stage) for testing and an electrostatic latent image pattern (lower stage) formed by the pattern. In this example, the photosensitive body being rotated is intermittently exposed to light with energies $L_M$ and $L_H$ to measure potential levels ($V_{HM1}$, $V_{WM1}$, $V_{LM1}$).

Step (b): Setting the charging condition of a photosensitive body and determination of the exposure energy:

Of the three potential levels, the highest potential $V_{HM1}$ depends on the charging condition of the photosensitive body whereas $V_{WM1}$ and $V_{LM1}$ depend on the exposure energies $L_{MS}$ and $L_{HS}$, respectively. The surface potential measuring circuit 12 includes an A/D converter circuit, and each of the surface potential values measured by the surface potential sensor 11 is converted into a digital value (e.g. 0–255 bits) which is supplied to the control unit 13. The control unit 13 includes a CPU and memory in which control data are stored.

Figure 5:
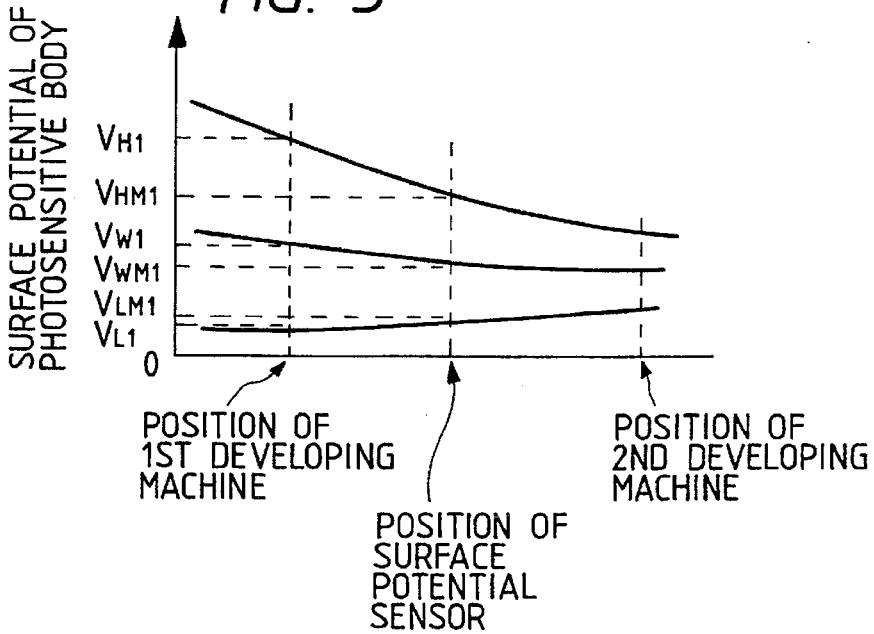
FIG. 5 is a graph showing the secular change of the surface potential of the photosensitive body in an electrostatic recording apparatus.

FIG. 5 shows the surface potentials at the positions of the first developer unit, surface potential sensor and second developer unit. As seen from FIG. 5, the surface potential of the photosensitive body varies with time so that at the position of the surface potential sensor, $V_1$ becomes $V_{HM1}$, $V_{W1}$ becomes $V_{VM1}$, and $V_{L1}$ becomes $V_{LM1}$. Estimating the changing degrees, the surface potential at the control position (surface potential sensor position), is previously set.

Figure 6:
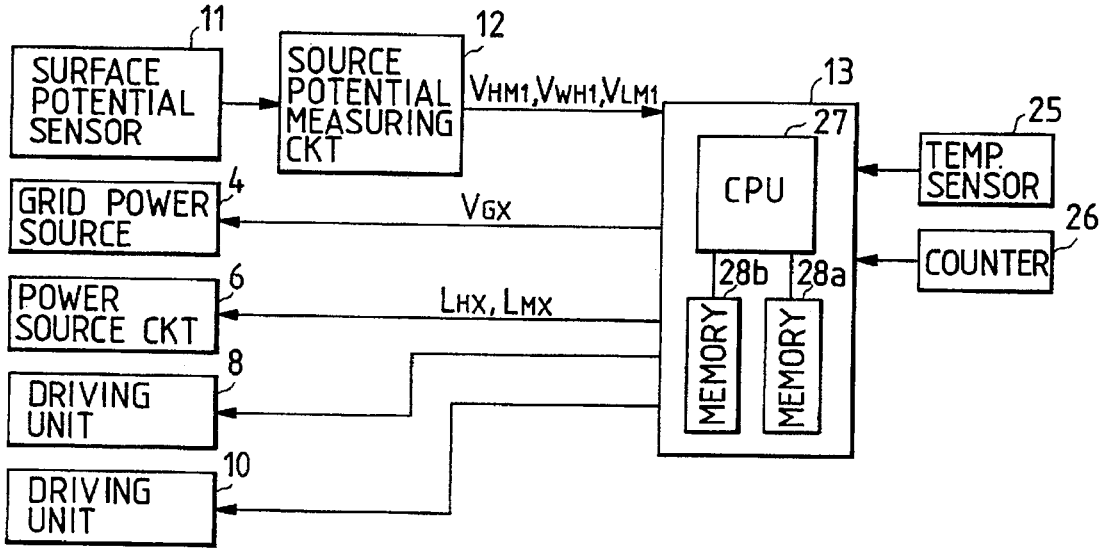
FIG. 6 is a block diagram showing the control system in the electrostatic recording apparatus.

FIG. 6 is a block diagram showing the system of a control system. As seen from FIG. 6, the control unit 13 includes a CPU 27 and two memories 28*a* and 28*b*. The surface potentials $V_{HM1}$, $V_{WM1}$ and $V_{LM1}$ measured by the surface potential sensor 11, temperature (or humidity) from the temperature (or humidity) sensor 25 provided in the electrostatic recording apparatus and printing page from the counter 26 for the printed pages are supplied to the control unit 13.

Figure 7:
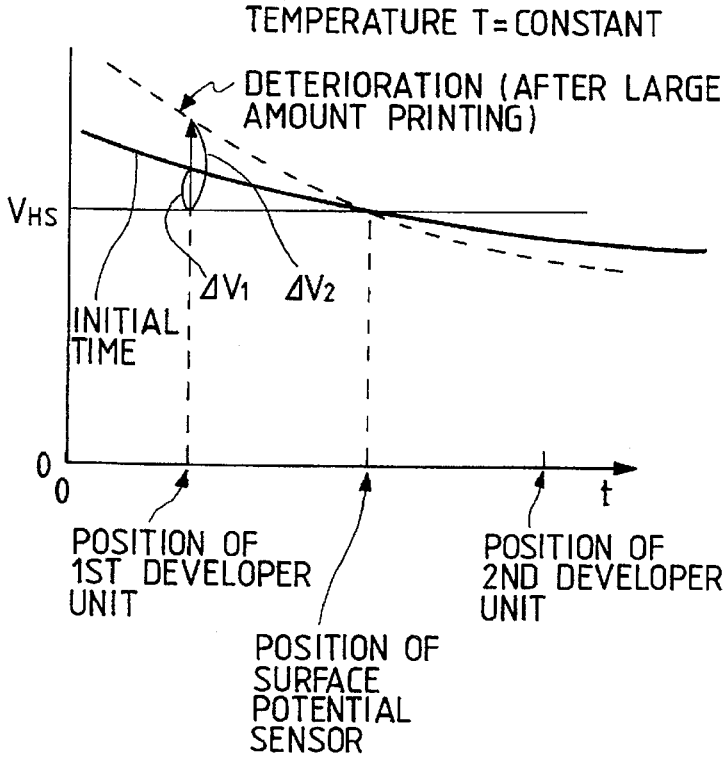
FIG. 7 is a characteristic graph showing the change in the control setting potential $V_{HS}$ at the initial time when the photosensitive body is used and after it has been used for a long time.

When the photosensitive body is used for a long time (i.e., the number of pages increases), it will be deteriorated owing to corona discharge, ozone, etc. so that the dark decay of the photosensitive body increases and the response characteristic of the photosensitive body in exposure to light will be deteriorated. FIG. 7 shows the control characteristic of the deteriorated photosensitive body. The solid line in FIG. 7 represents the surface potential in control for initial use, and the dotted line represents that used for a long time.

When the photosensitive body is used for a long time even with the environmental temperature (humidity) being constant, it will be deteriorated. For this reason, when the surface potential at the surface potential sensor is controlled to $V_{HS}$, the surface potential of the photosensitive body at the first developer unit is $V_{HS}+\Delta V_1$ at the initial time of use. On the other hand, when control is made for the photosensitive body deteriorated for a long time, the surface potential is $V_{HS}+\Delta V_2$. In order to fix the surface potential at the position of the first developer unit, the control setting potential at the position of the surface potential sensor corresponding to the using period (number of printed pages) of the photosensitive body must be made $V_{HS}-(\Delta V_2-\Delta V_1)$.

The temperature and humidity in the recording apparatus also changes the dark decay characteristic or residual potential. The control setting potential $V_{WS}$, which also exhibits the same tendency as $V_{HS}$ shown in FIG. 7, must be adjusted in accordance with the change in environmental condition.

Figure 8:
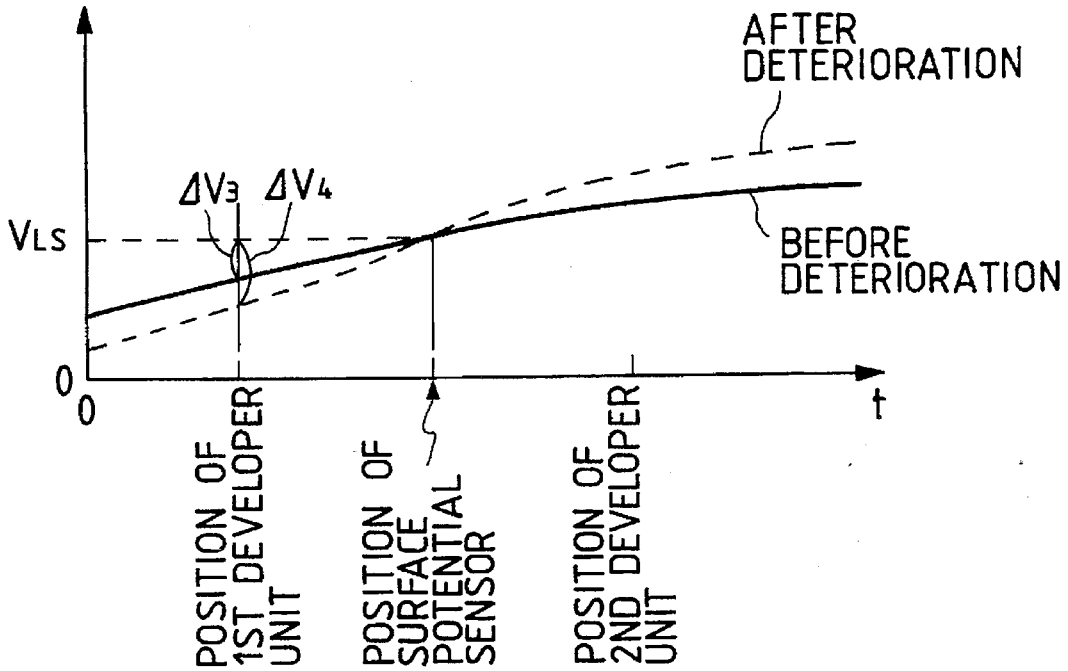
FIG. 8 is a characteristic graph showing the control setting potential $V_{LS}$ before and after the characteristic of the photosensitive body in the electrostatic recording apparatus is deteriorated.

When the residual potential $V_{LS}$ is controlled at the position of the surface potential sensor, as shown in FIG. 8, the surface potential before deterioration is $V_{LS}-\Delta V_3$ at the position of the first developer unit. When the temperature of the photosensitive body increases, the surface potential is $V_{LS}-\Delta V_4$ ($\Delta V_4>\Delta V_3$). In order that the surface potential at the position of the first developer unit is made always constant, therefore, the control setting potential at the surface potential sensor must be made $V_{LS}+(\Delta V_4-\Delta V_3)$ in accordance with the temperature (humidity) of the photosensitive body.

Figure 9:
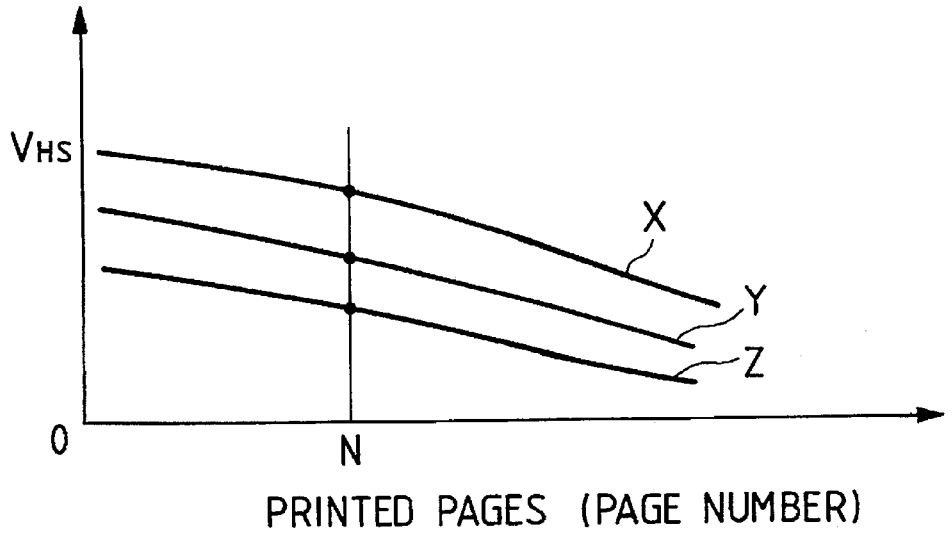
FIG. 9 is a characteristic graph showing the change in the control setting potential $V_{HS}$ according to an increase in the printed number of pages and a change in temperature or humidity in the electrostatic recording apparatus.

FIG. 9 is a graph showing a relation of the number of printed pages, temperature and humidity to a control setting potential $V_{HS}$. In the graph, curve X illustrates a change in the control setting potential $V_{HS}$ when the number of printed pages increases in the environment of low temperature and low humidity. curve Y illustrates a change in the control setting potential $V_{HS}$ when the number of printed pages increases in the environment of normal temperature and normal humidity. Curve Z illustrates a change in the control setting potential $V_{HS}$ when the number of printed pages increases in the environment of high temperature and high humidity.

Similarly, the data for the control setting potentials $V_{WS}$, $V_{LS}$ and $V_{HS}$ are experimentally obtained. These several kinds of control data are stored in a memory **28*b***.

Returning to FIG. 6 again, CPU 27 decides the environmental condition of the photosensitive body 1 on the basis of the characteristic change data such as the data of temperature (humidity) in the apparatus and the data of number of printed pages, reads the control setting voltages $V_{HS}$, $V_{WS}$ and $V_{LS}$ corresponding to the environmental condition and compares these data with the measured values $V_{HM1}$, $V_{WM1}$ and $V_{LM1}$ sent from the surface potential measuring circuit 12.

As a result of comparison, when the measured value $V_{HM1}$ is less than setting voltage $V_{HS}$, CPU 27 reads the grid voltage resetting value $V_{GX}$ (resetting value $V_{GX}$>setting voltage $V_{GS}$) from the memory **28*a* and supplies it to the grid power supply 4** to adjust the grid voltage.

When the measured value $V_{HM1}$ is less than setting voltage $V_{HS}$, CPU 27 reads the resetting value $V_{MX}$ (resetting value $V_{MX}$>setting voltage $V_{MS}$) from the memory **28*a* and supplies it to the exposure power supply 4** to adjust the light exposure energy.

When the measured value $V_{LM1}$ is less than setting voltage $V_{LS}$, CPU 27 reads the resetting value $V_{HX}$ (resetting value $V_{HX}$>setting voltage $V_{HS}$) from the memory **28*a* and supplies it to the exposure power supply 4** to adjust the light exposure energy.

As a result of these adjustments, new three potential levels become setting values $V_{HS}$, $V_{WS}$ and $V_{LS}$. Of $V_{HS}$, $V_{WS}$, $V_{LS}$, control of $V_{WS}$ which is a potential at the background is important. Not only $V_{WS}$ itself but also the differences between $V_{HS}$ and $V_{WS}$ and between $V_{LS}$ and $V_{WS}$ may be controlled so as to be predetermined values.

Step (c): Setting the bias voltage of the second developer unit 9:

As described above, with the grid voltage reset at $V_{GX}$ and the light exposure energy reset at $L_{MX}$ and $L_{HX}$, the photosensitive body is irradiated with the light exposure pattern for test to form the corresponding electrostatic latent pattern on the photosensitive body. Using the bias voltage $V_{B1}$ in the first developer unit 7 as a standard value ($V_{HS}>V_{B1S}>V_{WS}$), the electrostatic latent pattern is developed by the first developer unit 7 to print the first color. Thereafter, the surface potential of the photosensitive body is measured by the surface potential sensor 11. Since the first developer unit 7 executes normal development, toners are applied to the area at the latent potential $V_{HS}$.

Surface potentials $V_{VM2}$ and $V_{LM2}$ of areas at which are not developed by toners, are measured. In accordance with the environmental condition, the resistance of the developer in the first developer unit 7 and the surface resistance of the photosensitive body vary so that the values of $V_{VM2}$ and $V_{LM2}$ are not constant. Therefore, on the basis of the measured values, the bias voltage $V_{B2}$ of the second developer unit 9 is set to $V_{B2X}$ ($V_{WM2}>V_{B2X}>V_{LM2}$).

Even while the photosensitive body is used for a long time or the temperature (humidity) changes, by the operation of the above three steps, the latent image potential of the photosensitive body can be set to a predetermined value by a single surface potential sensor, thus providing stabilized image quality. Such a series of operations are not required for each printing, but may be effected at a suitable time such as the time of initiation of the electrostatic recording apparatus.

It is desirable that the above series of operations are effected also when the photosensitive body, developer and charge wire are replaced by others.

Embodiment 2

There is a method of controlling only the surface potential of a non-printed area as simple control of surface potential. Specifically, in this method, when the electrostatic recording apparatus is activated, or printing is started, the surface potential $V_{WM}$ of the non-printed area is measured at appropriate times at least in synchronism with the non-printing area. It is decided whether or not this surface potential is a setting value $V_{WM}$ at the initial operation. If not so, the voltage applied to the charger or light exposure energy is controlled so that the surface potential of the non-printing area (background) is the above setting surface potential.

Thus, since the difference between the potential at the non-printing area and the developing bias value can be maintained constant, generation of fog at the non-printing area can be prevented. The non-printing area which occupies about 80% or more of the printed paper area is an important item in image quality. It can be easily measured on the basis of the measuring resolution (2 mm or more) of the surface potential sensor 11.

Embodiment 3

A third aspect of the present invention will be explained with reference to FIG. 10. In this embodiment, mechanical means is adopted to stop the developing function of the first developer unit.

In this embodiment, the first developer unit uses a developing roll 21 including a magnet roll **21*a* and a sleeve 21*b*. The magnet roll 21*a*** is rotatable by a predetermined angle.

Figure 10A:
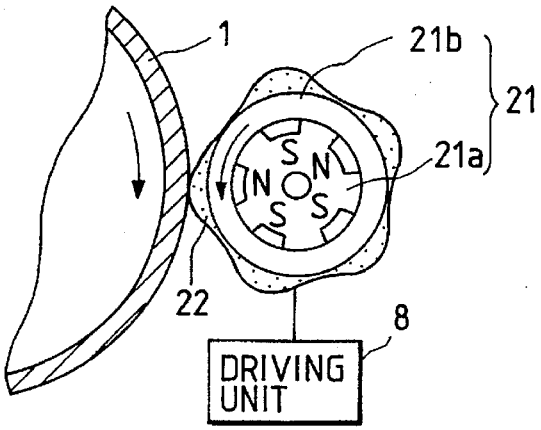
FIGS. 10A and 10B are views illustrating the position of the magnet roll in an electrostatic recording apparatus and the state of the magnetic brush of the development roll according to the third embodiment.
Figure 10B:
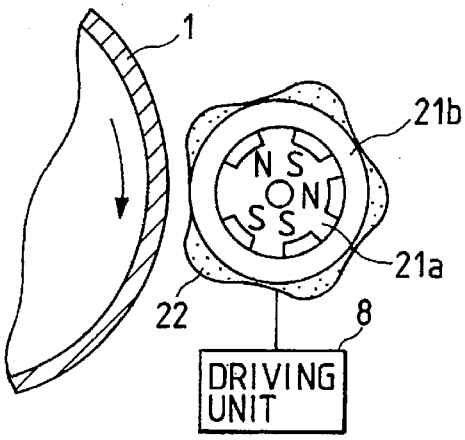

FIGS. 10A and 10B are diagrams showing the relation between a drum-shaped photosensitive body 1 and a developing roll 21.

FIG. 10A shows the positions of the magnetic poles of the magnet roll 21*a* during normal development. The N poles (or S poles) of the magnet roll 21*a* face the periphery of the photosensitive body 1. A magnetic brush 22 is formed on the outer surface of the sleeve 21*b*, and the hill of the magnetic brush 22 is kept in contact with the photosensitive body 22.

A bias power supply 8 is connected to the sleeve 21*b*. In order to effect the development, in the case of the normal development, the development bias voltage $V_B$ is set for a lower voltage than the image potential $_{L1}$ of the photosensitive body 1 ($V_B<V_{L1}$), and in the case of the reversal development, it is set for a higher voltage than the image potential $V_{H1}$ of the photosensitive body 1. Inversely, in order to stop development function, in the case of the normal development, the development bias voltage $V_B$ is set for a higher voltage than the image potential $V_{H1}$ of the photosensitive body ($V_B>V_{H1}$), and in the case of the reversal development, the development bias voltage $V_B$ is set for a much lower voltage than the image Potential $V_{L1}$ ($V_B<V_{L1}$; approximately zero volt is preferable).

In addition, or without making the control of a bias voltage $V_B$ as described above, as shown in FIG. 10B, the magnet roll 21*a* is rotated by a predetermined angle from the state of development, i.e. the magnetic pole position is changed so that the magnetic brush 22 is not brought into contact with the photosensitive body 1.

In development, the magnet roll 21*a* is returned to an original position so that the magnetic brush 22 is brought into contact with the photosensitive body 1, thereby enabling the development.

Embodiment 4

Figure 11:
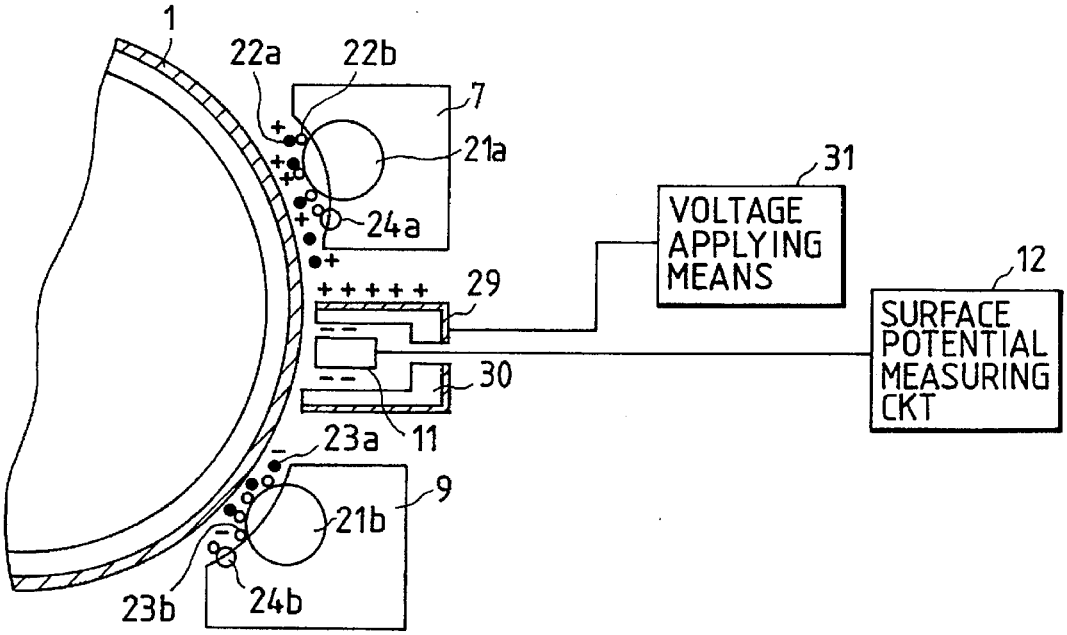
FIG. 11 is a schematic view of the main part of the electrostatic recording apparatus according to the fourth embodiment of the present invention.

A fourth aspect of the present invention will be explained with reference to FIG. 11. In this embodiment, as a surface potential sensor, a negative feedback type surface potential sensor correcting influence from a distance between an object to be measured and the sensor. The photosensitive layer formed on the surface of the photosensitive body 1 is an OPC photosensitive material minus-charged, The surface potential sensor 11 is used to measure the minus potential. A voltage of −700 V is applied to the probe box (metallic) for the surface potential sensor 11.

In this embodiment, the first developer unit 7 makes the normal development using plus-charged toners and the second developer unit 9 makes the reversal development using minus charged toners. Between the first developer unit 7 and the surface potential sensor 11, a first shading plate 29 which is made of aluminum and having an anodic oxidation processing film formed on the surface is provided. A voltage applying means 31 applies to the shading plate 29 a voltage of +100—+700 V having the same polarity as the toners used in the first developer unit 7.

Thus, since the plus toners 22*a* scattered from the first developer unit 7 are repelled from the shading plate 29 which is arranged before the probe of the surface potential sensor 11 and to which a plus voltage is applied, they are not applied to the surface potential sensor 11. Carriers 22*b* with minus-polarity are magnetically recovered by a catch-up roll 24*a*.

In the case of this embodiment, a second shading plate 30 is arranged between the surface potential sensor 11 and the second developer unit 9. Since the polarity of the toners 23*a* of the second developer unit 9 is minus, they will not be applied to the probe of the surface potential sensor 11. Namely, the second shading plate 30 has a physical shading effect.

Embodiment 5

Figure 12:
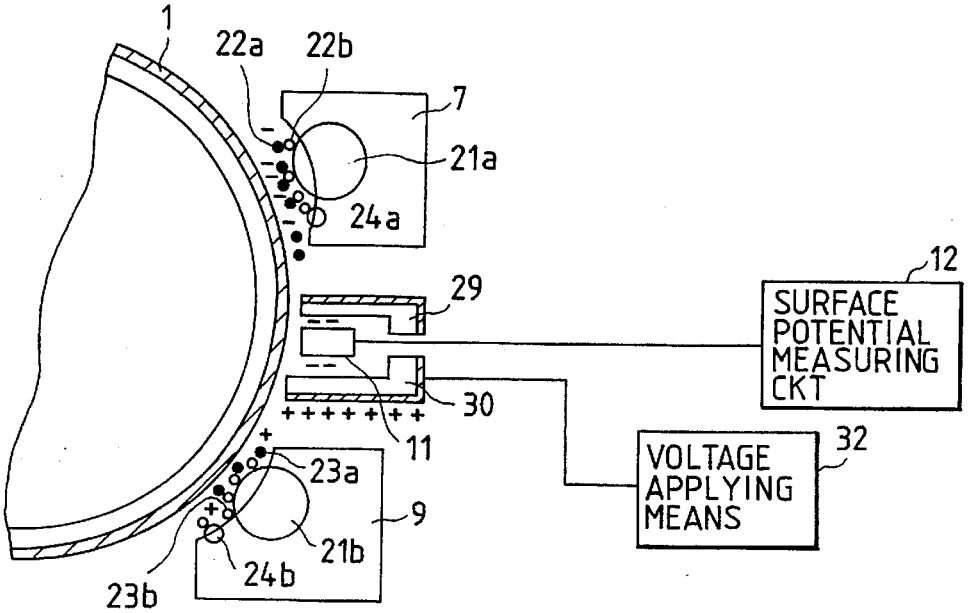
FIG. 12 is a schematic view of the main part of the electrostatic recording apparatus according to the fifth embodiment of the present invention.

Referring to FIG. 12, a fifth embodiment of the present invention will be explained. In this embodiment, the first developer unit 7 makes the reversal development using minus-charged toners whereas the second developer unit 9 makes the normal development using plus-charged toners. To the surface potential sensor 11, a minus voltage is applied. To the second shading plate 30 arranged between the surface potential sensor 11 and the second developer unit 9, a voltage having the same polarity as that of the toners used in the second developer unit 9 is applied by a voltage applying means 32. Between the first developer unit 7 and the surface potential sensor 11, the first shading plate 29 is arranged which has a physical shading effect. In this way, attachment of toners to the surface potential sensor 11 can be effectively prevented.

Embodiment 6

Figure 13:
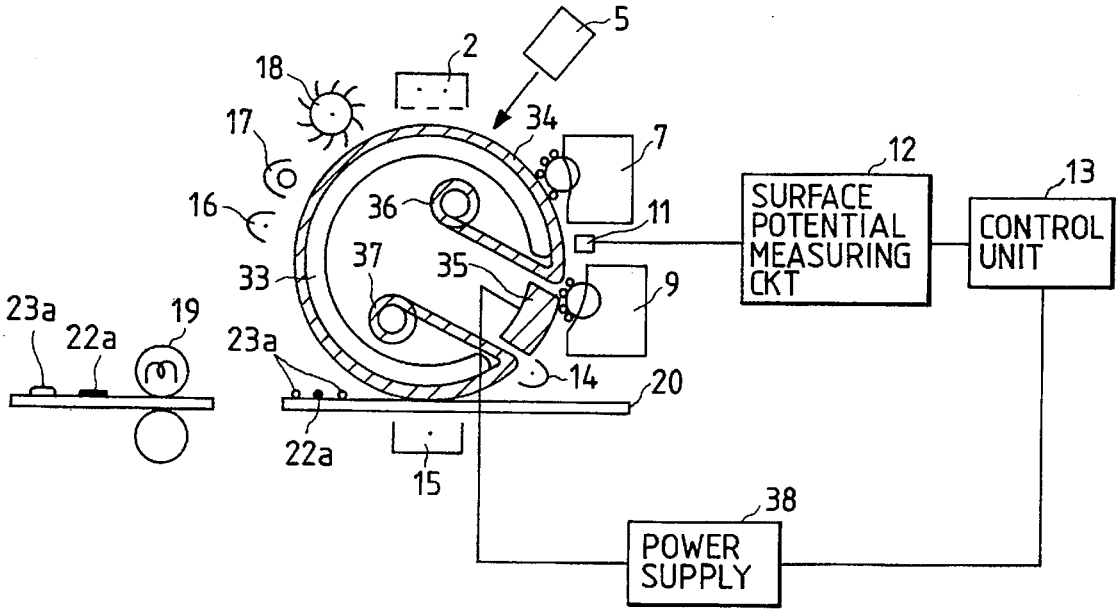
FIG. 13 is a schematic view of the main part of the electrostatic recording apparatus according to the sixth embodiment of the present invention.

Referring to FIG. 13, a sixth embodiment of the present invention will be explained. The photosensitive body, unlike the case of the first embodiment, is constructed in such a manner that a photosensitive sheet 34 is rolled on the outer periphery of a drum 33 made of aluminum, the unused photosensitive sheet 34 stored within the drum 33 is pulled out from a stock roll 36 through an opening of the drum and rolled on the drum 33, The photosensitive 34, after it is used, enters the drum 33 through again through the opening and taken up by a take-up roll 37. To a cap seal 35 which serve to seal the drum 33, a voltage is applied by a power supply 38.

The cap seal 35 is made of aluminum and has an anodic oxidization film formed on its surface. This film is a dielectric film which serves to prevent toners from being attached to the surface of the cap seal by force acting between the toner charges and the mirror charges induced in the cap seal 35.

As in the previous embodiments, the surface potential sensor 11 is arranged between the first developer unit 7 and the second developer unit 9. The cap seal 35 is so controlled that when it passes the developer units 7 and 9, its potential applies a voltage which is reverse to the bias voltage for the development roll, i.e. does not permit the toner development. The control operation will be explained assuming that the development bias voltages in the first and second developer units 7 and 9 are set to $V_{B1}$ and $V_{B2}$.

It should be noted that the cap seal 35 is controlled in different manners in accordance with whether the width in the peripheral direction of the photosensitive body is larger or smaller than the distance between the first and second developer units 7 and 9.

A case where the width of the cap seal 35 is smaller than the distance between the first and second developer units:

In the case where the first developer unit 7 makes the normal development and the second developer unit 9 makes the reversal development, when the cap seal 35 passes the first developer unit 7, a voltage not higher than $V_{B1}$ is applied to the cap seal 35, and when the cap seal 35 passes the second developer unit 9, a voltage not lower than $V_{B2}$ is applied to the cap seal 35.

A case where the width of the cap seal 35 is larger than the distance between the first and second developer units:

In this case, an intermediate value between $V_{B1}$ and $V_{B2}$ is applied to the cap seal 35. In the case where the development is effected by the tri-level development system as shown in FIG. 3, a voltage of $V_{WS}$ is applied to the cap seal 35.

Figure 14:
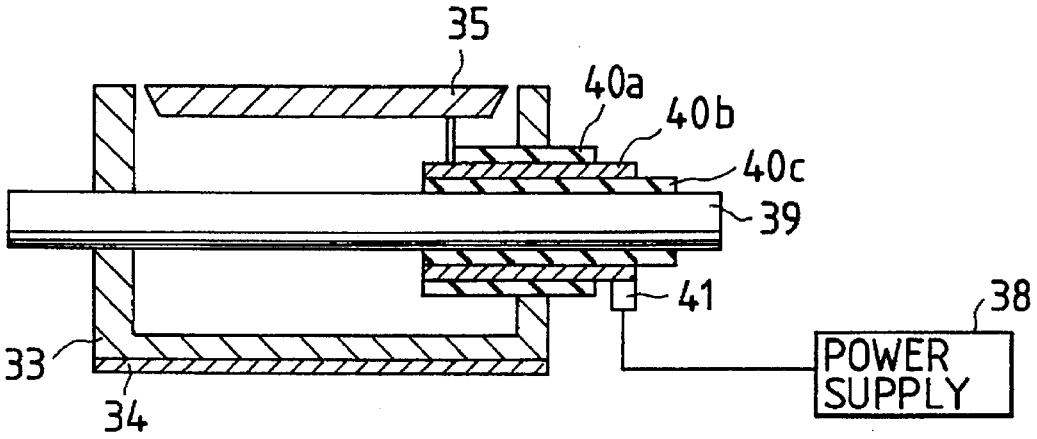
FIG. 14 is a sectional view of means of applying a voltage to the cap seal of the electrostatic recording apparatus according to the six embodiment.

Referring to FIG. 14, an explanation will be given for a means for applying a voltage using an external power supply 38. A rotary shaft 39 of the drum 33 is made of metal connected to ground. On the outer periphery of the rotary shaft 39, an insulating layer 40*c*, a conductive layer 40*b* and an insulating layer 40*a* are formed in this order from inside to outside. The cap seal 35 and the conductive layer 40*b* are connected to each other, and a bias voltage is applied to the cap seal 35 from a power supply 38 through a slip ring 41.

As described above, by applying a predetermined bias voltage to the cap seal 35, attachment of toners on the surface of the cap seal 35 during printing can be prevented, thus reducing wasteful consumption of the toners and burden of a cleaner 18.

Embodiment 7

At the time of measuring the latent potential of the photosensitive body in step (a) and setting the charging condition and light-exposure energy instep (b) as described in connection with the first embodiment, the power supply 38 is controlled by a control unit 13 so that as shown in FIG. 13, when the cap seal 35 passes in opposition to the surface potential sensor 11, reference latent potentials ($V_{HS}$, $V_{WS}$, $V_{LS}$) are successively applied to the cap seal 35 by the power supply 38.

The data read by the surface potential sensor 11 are stored in a memory in a surface potential measuring circuit 12 or the control unit 13. In comparison between the measured latent image potential of the photosensitive body and a memory-stored value, the control for setting the charging condition of the photosensitive body and the light exposure energy is executed.

Where the first developer unit 7 makes the normal development and the second developer unit 9 makes the reversal development, in order to prevent toners from being applied to the cap seal 35, voltages $V_{LS}$, $V_{WS}$ and $V_{HS}$ are preferably attached to the cap seal 35 in this order. Where the first developer unit 7 makes the reversal development and the second developer unit 9 makes the normal development, voltages $V_{HS}$, $V_{WS}$ and $V_{LS}$ are preferably applied to the cap seal 35 in this order.

As a result, even if poor accuracy occurs for the surface potential sensor 11, the substantial control can be effected. Incidentally, the surface potential sensor 11 and surface potential measuring circuit 12 can be so constructed that a calibration voltage applied to the cap seal 35 is equal to the value measured by the surface potential sensor 11.

Embodiment 8

In the sixth embodiment, the drum was adopted in which a voltage is applied to the cap seal 35 by the external power supply 38 as shown in FIG. 13.

Figure 15:
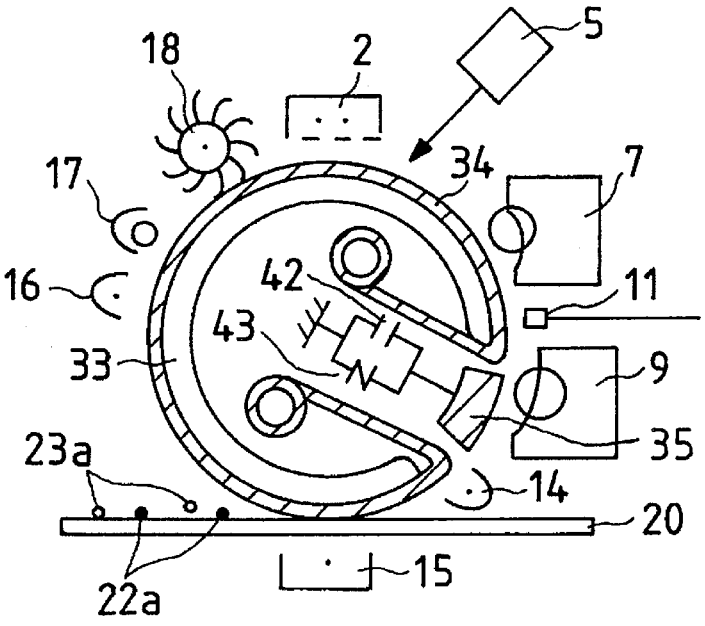
FIG. 15 is a sectional view of the main part of the electrostatic recording apparatus according to the eighth embodiment of the present invention.

In this embodiment, a technique not using the external power supply particularly in the tri-level development system is proposed. As shown in FIG. 15, a parallel circuit of a capacitor 42 and a voltage control element 43 is connected between the cap seal 35 and ground. It is assumed that the voltage control element 43 is a varistor. The varistor is a kind of non-linear resistive element whose resistance (Rv) increases as the voltage applied between its terminals decreases, thereby making a current difficult to flow.

When the cap seal 35 passes below the scorotron charger 2, a corona discharging current flows in the cap seal 35. Thus, the above capacitor 42 is charged. Assuming that the charging amount of charges is Qc and the capacitance of the capacitor 42 is C, the surface potential Vs of the cap seal 35 is represented by Qc/C.

When the cap seal 35 goes out from the charger 2 in accordance with the rotation of the photosensitive body, the charges stored in the capacitor 42 are discharged the resistance (Rv) of the varistor so that the potential lowers gradually. The time constant of the potential lowering depends on the product of C and Rv.

In order to prevent toners from being attached to the cap seal 35, the surface potential of the cap seal 35 is set for a value between the development bias $V_{B1}$ in the first developer unit 7 and the development bias $V_{B2}$ of the second developer unit, preferably the value close to reference latent potential $V_{WS}$ for the intermediate voltage level in the three voltage levels formed on the photosensitive body.

In FIG. 15, it is assumed that the photosensitive body is an OPC body and the values of $V_{HS}$, $V_{WS}$ and $V_{LS}$ are 750 V, 450 V and 150 V, respectively; and $V_{B1}$ and $V_{B2}$ are 550 V and 300 V, respectively. The time taken while the cap seal 35 moves from the charger 2 to the position of the first developer unit 7 is 0.2 sec. and the time taken while it moves from the position of the first developer unit to the surface potential sensor 11 is 0.1 sec., and the time while it moves from the surface potential sensor 11 to the second developer unit 11 is 0.1 sec.

Figure 16:
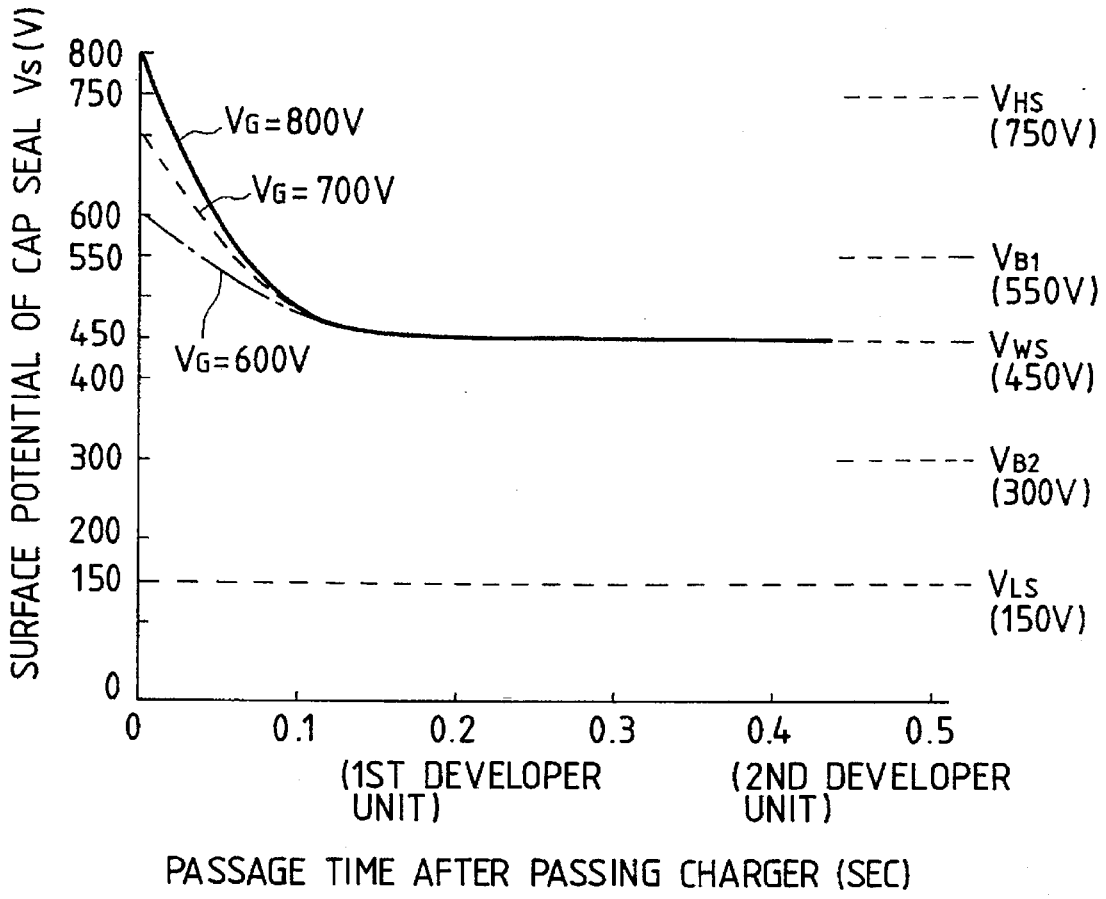
FIG. 16 is a sectional view of the time-varying surface potential of the cap seal of the electrostatic recording apparatus according to the eighth embodiment.
Figure 17A:
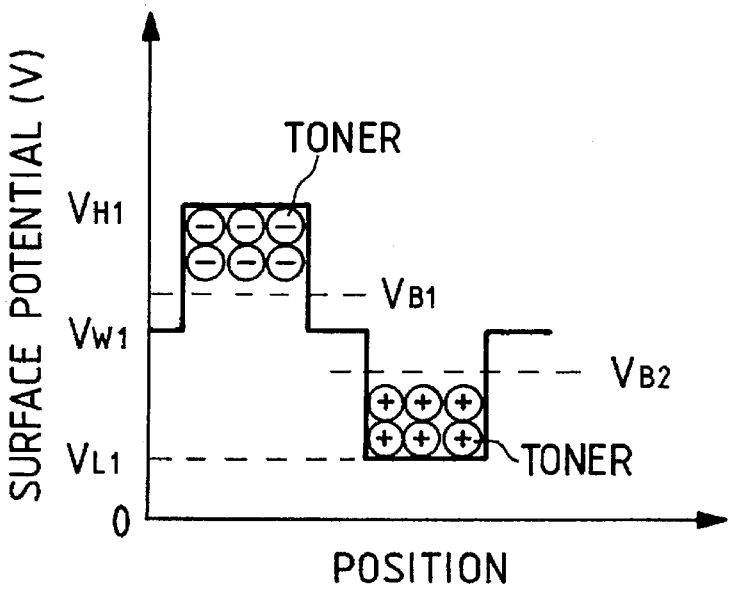
FIGS. 17A and 17B are a conceptual view and a characteristic graph for explaining the problem in two-color printing using a tri-level system and a characteristic, respectively.
Figure 17B:
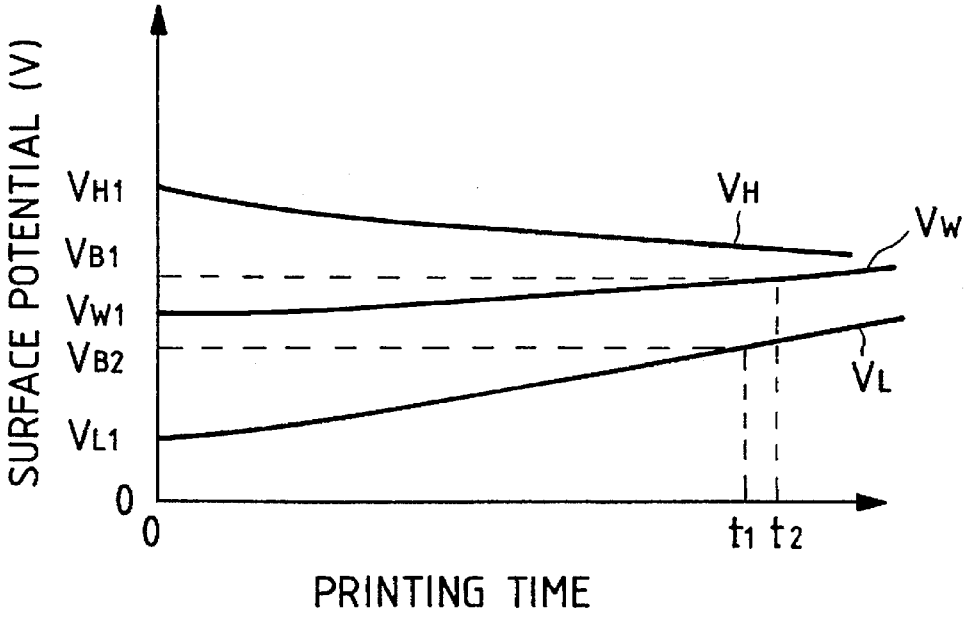

FIG. 16 shows, using the grid voltage $V_G$ of a "scorotron" charger as a parameter, the time-varying surface potential $V_S$ of the cap seal 35 composed of a varistor having a varistor voltage of 560 V and a capacitor having a capacitance of 0.02 μF.

As apparent from this graph, even when the grid voltage $V_G$ for controlling the surface potential of the photosensitive body is varied from 600 V to 800 V, the surface potential $V_S$ of the cap seal 35 could be fixed within a range of 450 V±10 V from the position of the first developer unit 7 to that of the second developer unit 9. Specifically, it could be fixed to the value close to the reference latent potential $V_{WS}$ for the intermediate potential level of the three electrostatic latent image potential levels formed on the photosensitive body so that attachment of toners to the cap seal 35 can be prevented.

Since the surface potential of the cap seal 35 when it passes the potential sensor passes is 450 V, the surface potential measured by the surface potential sensor 11 can be used for calibration of the surface potential sensor 11. In controlling the potential of the non-printed region of the photosensitive body, it may be used as the value of the reference latent image potential for the intermediate potential level.

In this embodiment, the reference latent image potential $V_{WS}$ was set for 450 V. But, where it is desired that the reference latent image potential is set for 400 V, a structure composed of a varistor having a varistor potential of 470 V and a capacitor having a capacitance of 0.05 μF may be used. In this way, if the time taken while the cap seal moves from the outlet of a charger to developer units and the surface potential sensor is known, the intermediate potential can be applied to the cap seal by an inexpensive technique of selecting a suitable varistor and capacitor.

The above first and third aspects of the invention can provide unaltered stabilized image quality in accordance with secular deterioration of the photosensitive body and changes in environmental conditions such as temperature and humidity. Using a single surface potential sensor permits color printing based on combination of normal development and reversal development to be controlled.

The second aspect of the present invention is to provide unaltered stabilized image quality in accordance with time-varying deterioration of the photosensitive body and changes in environmental conditions such as temperature and humidity even when the sensitivity of the surface potential sensor is reduced by any cause. Using a single surface potential sensor permits color printing based on combination of normal development and reversal development to be controlled.

The above fourth and fifth aspects of the invention can surely prevent reduction in precision of a surface potential sensor and invasion of toners into the probe of the surface potential sensor which leads to malfunction, and permits color printing based on combination of normal development and reversal development to be controlled.

The above sixth aspect of the invention can prevent application of toners when the cap seal passes the first developer unit and the second developer unit so that toner contamination in the apparatus can be surely prevented. The sixth aspect of the invention, therefore, permits color printing with high quality to be controlled, and wasteful consumption of toners to be canceled.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electrostatic recording control method performed by an electrostatic recording apparatus comprising a charger, an exposure device, a first developer unit, loaded with a first-color developer, and a second developer unit, loaded with a second-color developer, said first and second developer units being provided around a photosensitive body so that an electrostatic latent image, which is formed on the photosensitive body by operation of said charger and said exposure device, is successively developed by said first-color developer and said second-color developer charged with opposite polarities to form a two-color image, a single surface potential sensor provided in the neighborhood of said photosensitive body and between said first developer unit and said second developer unit, and a characteristic changing detecting means for detecting the characteristic of a factor influencing the dark decay characteristic of said photosensitive body; said method comprising the steps of:

irradiating the surface of said photosensitive body charged by said charger with a test pattern having a predetermined exposure energy by said exposure device to form a test electrostatic latent image on said photosensitive body;

measuring the surface potential of said test electrostatic latent image by passing the latent image under said surface potential sensor in the condition that the developing function of said first developer unit is substantially stopped;

changing a control setting potential at a position where said surface potential sensor is set on the basis of the output from said characteristic change detecting means;

controlling at least one of the voltage to be applied to said charger and the exposure energy for forming said test pattern, so that the measured potential becomes the control setting potential on the basis of the comparison of the potential measured by said measuring step and the control setting potential;

forming a test electrostatic latent image on said photosensitive body after said comparing step;

forming the first toner image corresponding to said test electrostatic latent image by applying a predetermined bias voltage to said first developer unit; and setting the bias voltage of said second developer unit on the basis of the measured surface potential of said first toner image.

2. An electrostatic recording control method according to claim 1, wherein said characteristic change detecting means includes at least one of a print-page-number counter, thermometer and hygrometer.

3. An electrostatic recording control method performed by an electrostatic recording apparatus comprising a charger, an exposure device, a first developer unit, loaded with a first-color developer, and a second developer unit loaded with a second-color developer, said first and second developer units being provided around a photosensitive body so that an electrostatic latent image, which is formed on the photosensitive body by operation of said charger and said exposure device, is successively developed by said first-color developer and said second-color developer charged with opposite polarities to form a two-color toner image, said photosensitive body being a drum on the outer periphery of which a moving photosensitive sheet is wound, a voltage applying means for applying a voltage to a conductive cap seal covering an inlet/outlet for the photosensitive sheet of said drum and a single surface potential sensor provided in the neighborhood of said photosensitive body and between said first developer unit and said second developer unit, said method comprising the steps of:

applying a control setting potential to said cap seal by said voltage applying means when said cap seal is opposite to said surface potential sensor while said photosensitive drum rotates to measure and store the surface potential of said cap seal by said surface potential sensor;

irradiating the surface of a photosensitive body charged by said charger with a test pattern having prescribed exposure energy by said exposure device to form a test electrostatic latent image on said photosensitive body;

measuring the surface potential of said test electrostatic latent image by passing the latent image under said surface potential sensor in the condition that the developing function of said first developer unit is substantially stopped;

controlling at least one of the voltage to be applied to said charger and the exposure energy for forming said test pattern, so that the measured potential becomes the storage potential on the basis of the comparison of the storage potential stored by said applying step and the measurement potential measured by said measuring step;

forming a test electrostatic latent image on said photosensitive body after the controlling step again;

forming the first toner image corresponding to said test electrostatic latent image by applying a predetermined bias voltage to said first developer unit; and setting the bias voltage of said second developer unit on the basis of the measured surface potential of said first toner image.

4. An electrostatic recording control method according to claim 1 or 3, wherein said test latent image has an exposure portion and a non-exposure portion.

5. An electrostatic recording method according to claim 4, wherein said exposure portion has two or more exposure segments with different exposure energies.

6. An electrostatic recording control method according to claim 1 or 3, further comprising the steps of:

forming an electrostatic latent image having three potential levels on said photosensitive body in said step of forming the test electrostatic latent image on said photosensitive body to provide a non-printing region having an intermediate potential level in the three potential levels;

measuring the surface potential of said non-printing region in synchronism with at least said non-printing region in said three potential levels after the printing is started to decide whether the surface potential measured thus is an initial setting value when the printing is started; and if it is not the initial setting value, controlling either one of the voltage to be applied to said charger and exposure energy forming the latent image with the intermediate potential level.

7. An electrostatic recording control method according to claim 1 or 3, wherein said first developer unit is a developer unit for normal development, and the bias voltage of said first developer unit is made larger than the potential at the image portion of the photosensitive body so that the developing function of said first developer unit is substantially stopped.

8. An electrostatic recording control method according to claim 1 or 3, wherein said first developer unit is a developer unit for reversal development, and the bias voltage of said first developer unit is made larger than the potential at the image portion of the photosensitive body so that the developing function of said first developer unit is substantially stopped.

9. An electrostatic recording control method according to claim 1 or 3, wherein said first developer unit has a developing roll consisting of a rotatable magnet roll and a sleeve, and developer on the developing roll moves on a magnet pole position of said magnet roll so that it is not brought into contact with said photosensitive body, thereby substantially stopping the developing function of the first developer unit.

10. An apparatus for use with an electrostatic recording apparatus comprising a charger, an exposure device, a first developer unit, loaded with a first-color developer, and a second developer unit, loaded with a second-color developer, said first and second developer units being provided around a photosensitive body so that an electrostatic latent image, which is formed on the photosensitive body by operation of said charger and said exposure device, is successively developed by said first-color developer and said second-color developer charged with opposite polarities to form a two-color toner image, said apparatus comprising:

a single surface potential sensor provided in the neighborhood of said photosensitive body and between said first developer unit and said second developer unit;

characteristic changing detecting means for detecting the characteristic of a factor influencing the dark decay characteristic of said photosensitive body;

changing means for changing a control setting potential on the basis of the output from said characteristic change detecting means; and control means for measuring the surface potential of a non-image region formed on said photosensitive body by said surface potential sensor and controlling at least one of the voltage to be applied to said charger and exposure energy of said exposure device so that the measured potential becomes a control setting potential produced from said changing means.

11. An apparatus according to claim 10, wherein said characteristic change detecting means consists of at least one of a print-page-number counter, thermometer and hygrometer.

12. An apparatus for use with an electrostatic recording apparatus comprising a charger, an exposure device, a first normal developer unit, loaded with a first-color developer, and a second reversal developer unit, loaded with a second-color developer, said first and second developer units being provided around a photosensitive body so that an electrostatic latent image, which is formed on the photosensitive body by operation of said charger and said exposure device, is successively developed by said first-color developer and said second-color developer charged with opposite polarities to form a two-color toner image, said apparatus comprising:

a surface potential sensor provided in the neighborhood of said photosensitive body and between said first developer unit and said second developer unit; and a shielding member to which a voltage with the same polarity as the toner of said first normal developer unit is applied and provided between said first normal developer unit and the surface potential sensor.

13. An apparatus for use with an electrostatic recording apparatus comprising a charger, an exposure device, a first reversal developer unit, loaded with a first-color developer, and a second normal developer unit, loaded with a second-color developer, said first and second developer units being provided around a photosensitive body so that an electrostatic latent image, which is formed on the photosensitive body by operation of said charger and said exposure device, is successively developed by said first-color developer and said second-color developer charged with opposite polarities to form a two-color toner image, said apparatus comprising:

a surface potential sensor provided in the neighborhood of said photosensitive body and between said first reversal developer unit and said second normal developer unit; and a shielding member to which a voltage with the same polarity as the toner of said second normal developer unit is applied and provided between said surface potential sensor and said second normal developer unit.

14. An apparatus for use with an electrostatic recording apparatus comprising a charger, an exposure device, a first developer unit, loaded with a first-color developer, and a second developer unit, loaded with a second-color developer, said first and second developer units being provided around a photosensitive body so that an electrostatic latent image, which is formed on the photosensitive body by operation of said charger and said exposure device, is successively developed by said first-color developer and said second-color developer charged with opposite polarities to form a two-color toner image, said photosensitive body being a photosensitive drum on the outer periphery of which a moving photosensitive sheet is wound, said apparatus comprising:

a voltage applying means for applying a voltage to a conductive cap seal covering an inlet/outlet for the photosensitive sheet of said drum; and voltage application control means for controlling said voltage applying means so that the surface potential of said cap seal is reverse-biased with respect to the bias voltage for the development roll of said first developer unit when said cap seal is in a position opposing said first developer unit and said cap seal is reverse-biased with respect to the bias voltage for the development roll of said second developer unit when said cap seal is in a position opposing said second developer unit.

15. An apparatus according to claim 14, wherein said voltage application means for applying a voltage to said cap seal is a parallel circuit consisting of a capacitor and a voltage control element connected between said cap seal and ground, and the capacitance of said capacitor and the characteristic of said voltage control element are so selected that the charge charged in the capacitor of said parallel circuit by corona discharging current flowing into the cap seal when the cap seal passes below said latent image forming charger and the surface potential of said cap seal depending on the characteristic of said voltage control element are substantially equal to an intermediate potential between a development bias voltage of said first developer unit and that of said second developer unit when said cap seal passes through said first developer unit and said second developer unit.

16. An apparatus according to claim 15, wherein the capacitance of said capacitor and the characteristic of said voltage control element are so selected that the surface potential of said cap seal is substantially equal to an intermediate potential of a non-developed non-printing area among testing electrostatic latent images having three potential levels formed on said photosensitive body by said charger and said exposure means.

* * * * *